US006418297B1

(12) United States Patent
Yamatani et al.

(10) Patent No.: US 6,418,297 B1
(45) Date of Patent: Jul. 9, 2002

(54) CLEANING APPARATUS FEATURING A VIBRATING TONER CARRIER FEATURE OF SPECIFIED LENGTH AND IMAGE FORMING APPARATUS USING SAME

(75) Inventors: Mitsuru Yamatani, Toride; Keishi Osawa, Yokohama; Osamu Sugino, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,837

(22) Filed: Sep. 7, 2000

(30) Foreign Application Priority Data

Sep. 10, 1999 (JP) ..... 11-257658

(51) Int. Cl.[7] ..... G03G 21/10
(52) U.S. Cl. ..... 399/358
(58) Field of Search ..... 399/350, 351, 399/358–360

(56) References Cited

U.S. PATENT DOCUMENTS 4,530,594 A * 7/1985 Adachi ..... 399/360
5,450,185 A * 9/1995 Kuribayashi et al. ..... 399/350
6,055,405 A * 4/2000 Knott et al. ..... 399/358
6,219,523 B1 * 4/2001 Kobayashi ..... 399/358

* cited by examiner

*Primary Examiner*—William J. Royer
(74) *Attorney, Agent, or Firm*—Fitzpatrick, Cella, Harper & Scinto

(57) ABSTRACT

The present invention provides a cleaning apparatus for cleaning an image bearing member, which has a cleaning member for cleaning a toner from the image bearing member by contacting with the image bearing member, and carrying device for carrying the toner cleaned by the cleaning member, in a direction of a generatrix of the image bearing member, the carrying device being vibrated, a distance between the carrying device and a portion of contact of the cleaning member with the image bearing member being smaller than 8 mm.

24 Claims, 5 Drawing Sheets

CLEANING APPARATUS FEATURING A VIBRATING TONER CARRIER FEATURE OF SPECIFIED LENGTH AND IMAGE FORMING APPARATUS USING SAME

BACKGROUND OF THE INVENTION

1. Field of the Invention

This invention relates to a cleaning apparatus for cleaning (removing) a toner from a member to be cleaned such as an image bearing member, and further to an image forming apparatus such as a copier, a printer or a facsimile apparatus which can use such cleaning apparatus.

2. Related Background Art

In a well-known image forming apparatus which repeats the step of transferring a toner image formed on the surface of an image forming member being moved to a recording material such as paper, it is difficult for all the toner to be completely transferred to the recording material during transfer, and after the transfer, part of the toner unavoidably remains on the surface of the image bearing member.

Accordingly, it is a requisite condition for obtaining image of good quality to sufficiently remove the residual toner before entering the next image forming step, and as a cleaning apparatus for that purpose, an apparatus in which a cleaning blade formed of an elastic material such as urethane rubber closely contacts with the surface of the image bearing member to thereby remove any residual toner which has not contributed to the transfer is simple and compact in construction and is excellent in the toner removing function and has therefore been widely used heretofore.

Now, among cleaning apparatuses, there is one designed such that collected toner is directed to a toner carrying path in the apparatus, and the toner is carried by a toner carrying screw member provided in this toner carrying path and this toner is contained and collected as a waste toner in a collected toner bottle or the like.

In recent years, however, it has become the mainstream to dispose a photosensitive drum and a fixing apparatus in proximity to each other to downsize the copier and shorten FCOT (first copy time) which is the first copy discharge time, and the fixing apparatus is disposed just near the cleaning apparatus, and the cleaning apparatus becomes liable to be affected by the heat of the fixing apparatus.

Also, from the viewpoint of using a toner of a low melting point from the necessity of curtailing electric power concerned in fixing as an energy saving countermeasure, or making the quality of image high, the development for making the particles of the toner finer has been advanced, and the following problems have arisen in the development of such a toner.

That is, in a cleaning apparatus 30 shown in FIG. 9 of the accompanying drawings, a screw of a spiral shape having a shaft 35*a* as shown in FIG. 10 of the accompanying drawings is often used as a carrying screw 35, and in this carrying screw 35, the outer diameter thereof is 15.4 mm, whereas the diameter of the shaft thereof is about 8 mm. This carrying screw 35 is rotated in the direction of arrow S in FIG. 10, whereby a waste toner is carried in the direction of arrow T.

There has arisen the problem that the waste toner remaining not carried by the carrying screw 35 is packed in a space surrounded by a cleaning member 34 and a scooping sheet 36 shown in FIG. 9, and this packed waste toner is heated by the heat of a fixing apparatus 40 disposed near the cleaning apparatus 30 and is crushed against an image bearing member 20, and is mechanically damaged and fused on the surface of the image bearing member 20. Particularly, the above-noted problem is liable to arise in a toner lowered in its melting point or a toner using a resin binder of low hardness to make the particles thereof finer.

SUMMARY OF THE INVENTION

It is an object of the present invention to provide a cleaning apparatus and an image forming apparatus which prevent the fusion of waste toner onto an image bearing member.

It is another object of the present invention to provide a cleaning apparatus and an image forming apparatus which removes a toner well.

Further objects and features of the present invention will become more fully apparent from the following detailed description when read with reference to the accompanying drawings.

DESCRIPTION OF THE PREFERRED EMBODIMENTS

Some embodiments of the present invention will hereinafter be described with reference to the accompanying drawings.

<Embodiment 1>

Figure 1A:
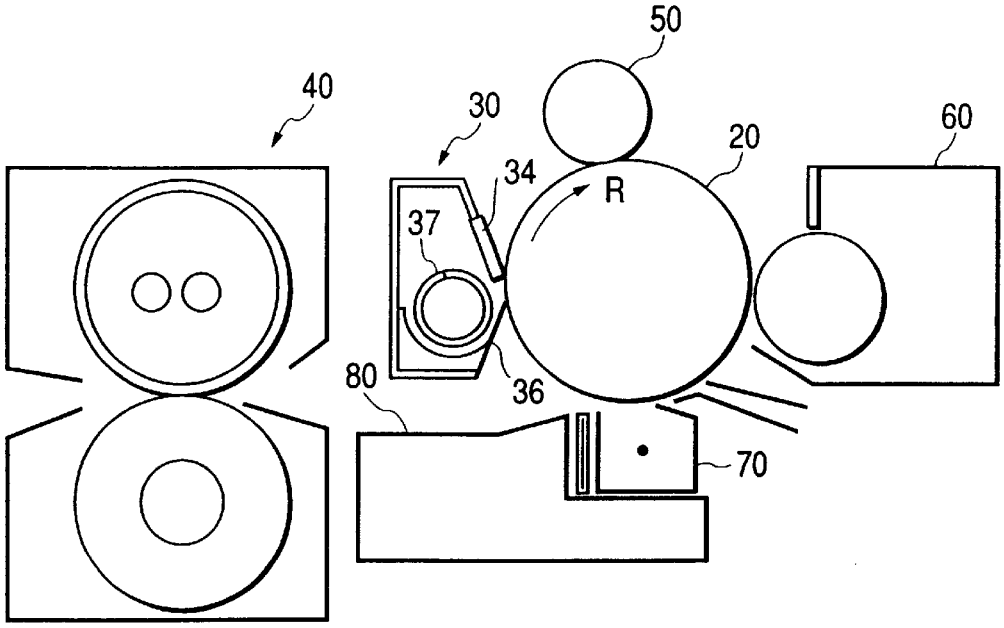
FIGS. 1A and 1B are cross-sectional views of the essential portions of an image forming apparatus according to Embodiment 1 of the present invention.
Figure 1B:
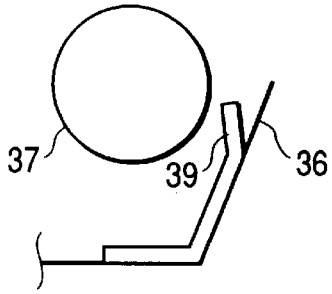
Figure 2:
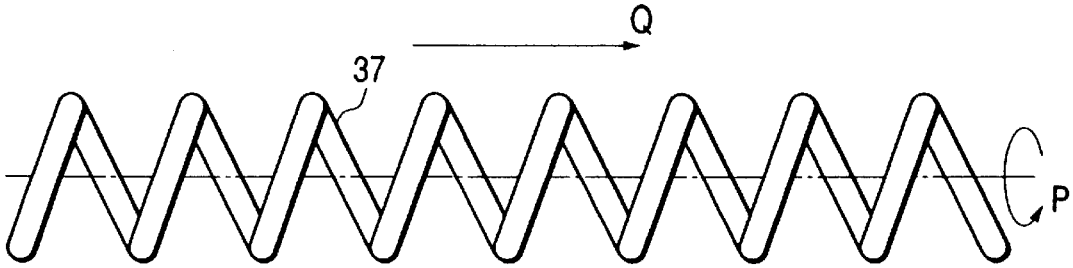
FIG. 2 is a partial side view of the carrying screw (spring screw) of the image forming apparatus according to Embodiment 1 of the present invention.

FIG. 1A is a cross-sectional view of the essential portions of an image forming apparatus provided with a cleaning apparatus according to Embodiment 1 of the present invention, FIG. 1B is an enlarged view of the vicinity of the receiving sheet member of the cleaning apparatus, and FIG. 2 is a fragmentary side view of the carrying screw (spring screw) of the cleaning apparatus.

In FIG. 1A, the reference numeral 20 designates a photosensitive drum constructed with a photoconductive substance applied to the peripheral surface thereof, and this photosensitive drum 20 is rotatively driven in the direction of arrow R and has its surface uniformly charged by a charger 50. The charged portion of this photosensitive drum 20 is subjected to optical image exposure by an optical signal generating device, not shown, whereby an electrostatic latent image is formed on this portion. This electrostatic latent image is developed by a developing apparatus 60 and visualized as a toner image. The toner image formed in this manner is transferred to transferring paper by a transferring charger 70, and the transferring paper to which the toner image has been transferred is separated from the photosensitive drum 20, is sent to a fixing apparatus 40 via a short conveying path 80 of 100 mm, and has the toner image thereon fixed by the fixing apparatus 40 and thereafter is discharged out of the apparatus. The shortest distance between the outer wall of the cleaning apparatus 30 and the outer wall of the fixing apparatus 40 is 10 mm. It is preferable that the distance between the transferring position of the transferring charger 70 and the fixing position of the fixing apparatus 40 along the conveying path 80 be a distance smaller than a government postcard, (147 mm×100 mm), i.e., smaller than 147 mm, so that the postcard can be longitudinally fed.

Now, untransferred toner remains on the surface of the photosensitive drum 20, and this toner is scraped off by a cleaning blade 34 which is a cleaning member being in contact with the surface of the photosensitive drum 20. The toner thus scraped off is carried from this side toward the inner part side of FIG. 1A, i.e., along the bus line direction of the photosensitive drum 20, by the rotation of a carrying screw 37 provided in parallelism to the rotary shaft of the photosensitive drum 20, and is discharged into a waste toner collecting box, not shown, disposed inside the main body of the image forming apparatus.

Also, in FIGS. 1A and 1B, the reference numeral 36 denotes a scooping (dipping) sheet which is a receiving sheet member for receiving the toner removed by the cleaning blade 34, and preventing the leakage of the falling toner out of the cleaning apparatus 30. The angle of entry of the cleaning blade 34 into the photosensitive drum 20 is 24°, and the angle of entry of the scooping sheet 36 into the photosensitive drum 20 is comparable to the angle of entry of the cleaning blade 34 and both of the cleaning blade 34 and the scooping sheet 36 are in close contact with the photosensitive drum 20 with an opening of 1 mm. This is the optimum cleaning construction for the photosensitive drum 20 having a diameter of 30 mm.

Now, the carrying screw 37 has a spring shape as shown in FIG. 2, and this is rotated in the direction of arrow P, whereby the waste toner is carried in the direction of arrow Q in FIG. 2. An SWIC material having a line diameter of 2 mm is used as the carrying screw (hereinafter referred to as the spring screw) 37, and the spring diameter and spring pitch thereof are set to 14 mm and 10 mm, respectively, and the screw 37 is rotatively driven at a number of rotations 2.7 rps.

Thus, the spring screw 37 is constituted by a spring and has no shaft and therefore, more or less vibration occurs during the rotation thereof, and a driving range spreads radially thereof. Thus, the spring screw 37 rotates while vibrating. Also, the side opposite to the driving side of the screw is an open end, and this also contributes to vibration.

Such a spring screw 37 is disposed near the photosensitive drum 20, as shown in FIG. 1A, but as previously described, vibration occurs when the spring screw 37 is rotated and therefore, the waste toner packed in the space surrounded by the cleaning blade 34 and the scooping sheet 36 is destroyed by the vibration of the spring screw 37. Although not occurring under an ordinary environment, a phenomenon called the fusion in which the waste toner in the cleaner portion causes blocking near the cleaning blade 34 and is locally secured onto the photosensitive drum 20 has sometimes occurred particularly at high temperatures. When the fusion of this waste toner occurs, this fusion does not disappear from the photosensitive drum 20, but conversely increases more and more with the fused portion as the starting point and therefore deteriorates the image, and when it becomes worse, there arises a situation in which poor cleaning or the injury of the photosensitive drum 20 occurs and the function of the copier is stopped.

Now, in the present embodiment, the distance between the fixing apparatus 40 and the cleaning apparatus 30 is as short as about 10 mm and thus, the cleaning apparatus 30 is heated and raised in temperature by the radiant heat of the fixing apparatus 40, and it has been found from the actual measurement that the temperature of the cleaning apparatus 30 exceeds 50° C.

Figure 3:
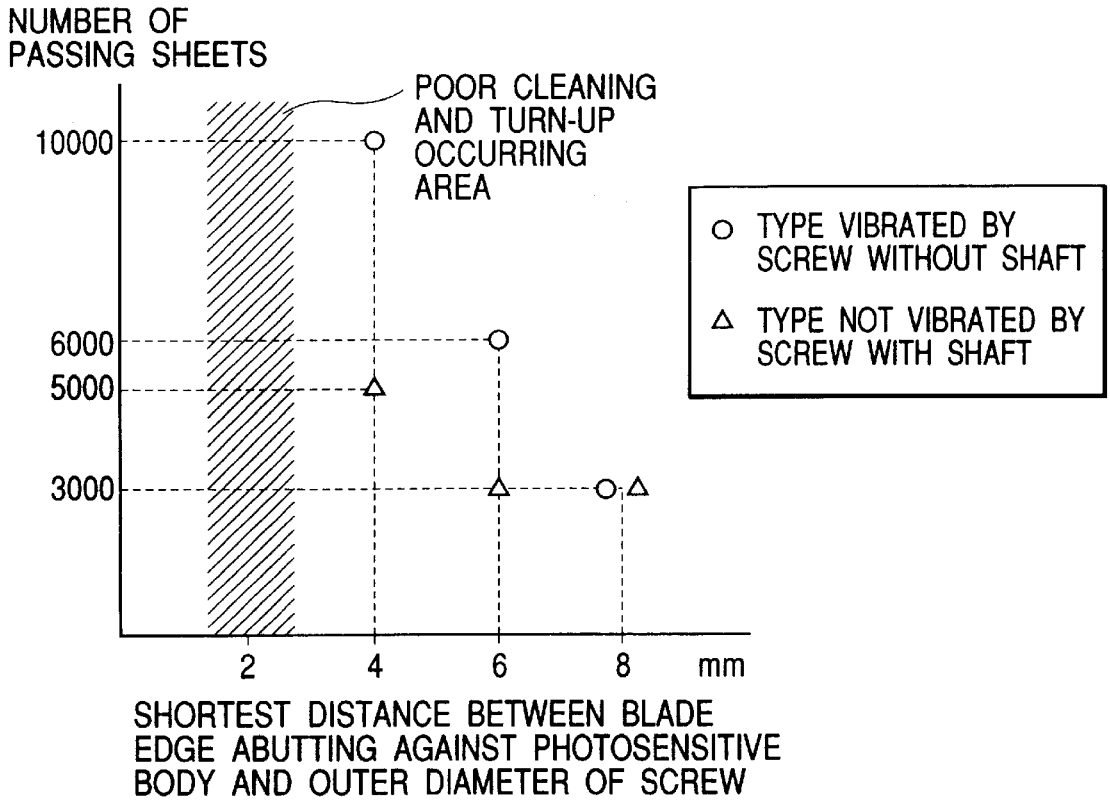
FIG. 3 shows the relation between the shortest distance between a blade edge and the outer diameter of the screw and fusion.

In an experiment wherein the temperature of the cleaning apparatus was raised to the order of 55° C., the occurrence of fusion was compared with the distance between the edge portion of the cleaning blade closely contacting with the photosensitive drum and the outer diameter of the carrying screw changed, and the result is shown in FIG. 3.

Figure 10:
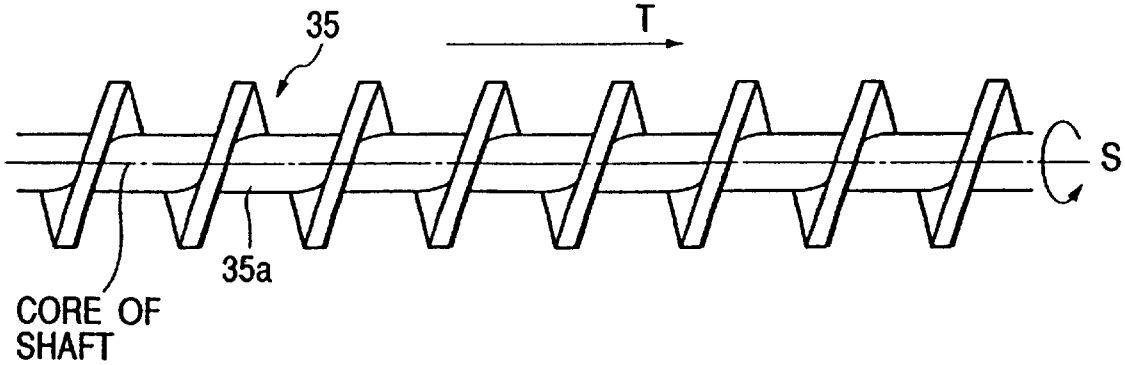
FIG. 10 PRIOR ART
FIG. 10 is a partial side view of the carrying screw of the image forming apparatus according to the prior art.

In FIG. 3, the result when use was made of a carrying screw of a type vibrated by a screw without a shaft (FIG. 2) is shown by the mark ○, and the result when use was made of a carrying screw not vibrated by a conventional screw with a shaft (see FIG. 10) is shown by the mark Δ. When the shortest distance between the blade edge and the outer diameter of the screw was 8 mm, fusion occurred after the passing of 3,000 sheets for both of the carrying screw vibrated by the screw without a shaft and the carrying screw not vibrated by the conventional screw with a shaft, whereas when the shortest distance between the blade edge and the outer diameter of the screw was 6 mm, fusion did not occur till after the passing of 6,000 sheets for the carrying screw vibrated by the screw without a shaft, and fusion occurred at the passing of 3,000 sheets for the carrying screw not vibrated by the conventional screw with a shaft, and this latter had no difference from the case where the shortest distance was 8 mm.

Further, when the shortest distance is approximated to 4 mm, the carrying screw vibrated by the screw without a shaft is confined to very slight fusion even for 10,000 sheets, and it has been found that this is very effective. At this time, some effect is obtained even for the carrying screw not vibrated by the conventional screw with a shaft and fusion does not occur up to 5,000 sheets, but the difference thereof from the present invention was obvious.

From the result of the above-described experiment, it has been found that it is more effective for the prevention of fusion to dispose the spring screw 37 near the photosensitive drum 20. That is, the distance between the blade edge and the outer diameter of the screw without a shaft may preferably be smaller than 8 mm.

When the temperature of the blade edge portion is low, the untransferred toner is moved to the vicinity of the blade edge and the toner interrupted thereby keeps fluidity to a certain extent and therefore, the force which pushes up the toner along the edge is great, and the toner is brought up to above the blade and falls by gravity and therefore stagnates without cohering.

On the other hand, when the temperature of the blade edge portion becomes high, the toner interrupted by the blade edge loses fluidity and becomes liable to cohere, and the force with which the toner is pushed up along the edge becomes small and the movement of the toner becomes null. Therefore, a lump of cohering toner remarkably becomes a cohering block with a size of the order of 4 to 5 mm only in the portion near the blade edge over the entire axial area of the blade. This can also be seen from the fact that it begins to be effective for the carrying screw not vibrated by the conventional screw with a shaft to approximate to 4 mm.

Accordingly, it is conceived that when the spring screw 37 is spaced apart by 8 mm, even if this spring screw 37 is vibrated, the lump of cohering toner interrupted by the blade edge portion cannot be destroyed, and the temperature of the blade portion rises, whereby the toner locally coheres on the frictionally sliding portion between the cleaning blade 34 and the photosensitive drum 20, and this cohering toner melts and fusion occurs. In contrast, the spring screw 37 approximates to 4 mm and is vibrated, whereby it becomes possible to destroy the lump of cohering toner interrupted by the blade edge portion, and a hollow wall is created and the forced circulation of the waste toner also occurs and therefore, the temperature of the cleaning blade 34 portion lowers and the cohering toner on the frictionally sliding portion between the cleaning blade 34 and the photosensitive drum 20 also suddenly decreases and therefore, the occurrence of localized cohesion and fusion can be restrained.

Now, in the case of the screw with a shaft of which the vibration can be restrained, even if it was approximated to 4 mm, the lump of cohering toner interrupted by the blade edge portion could not completely be destroyed, and the temperature of the blade portion rose, whereby for 5,000 sheets, the localized cohesion and fusion of the toner likewise occurred on the frictionally sliding portion between the cleaning blade and the photosensitive drum. When the screw with a shaft was further approximated to 2 mm, the carrying screw contacted with the cleaning blade and the poor cleaning and the turn-up of the blade by the vibration of the blade occurred.

It has been found from the above-described experiment that as the temperature of the cleaning apparatus rises and approximates to the toner glass transition point, the fluidity of the toner is aggravated and in the case of the screw with a shaft, the waste toner begins to adhere to the shaft portion and the screw is liable to assume the state of a dumpling, and from when the temperature of the cleaning apparatus becomes the vicinity of 55° C., the carrying force in the axial direction is suddenly reduced to thereby make the toner around the screw cohere.

On the other hand, the spring screw 37 vibrated by the screw without a shaft has its interior made into a cavity, and carries the waste toner by the spring of the outer peripheral portion thereof and also carries the toner while vibrating and therefore, it never happens that the spring screw 37 itself assumes the state of a dumpling, and the toner around the spring screw 37 can be carried without cohering. This is considered to be because the toner around the spring screw 37 is carried while being introduced into the spring screw 37, and it is conceived that the cohering toner contributing to the fusion on the blade edge portion also falls by gravity and vibration because a hollow wall is created on the upstream side of the blade edge, and is introduced into the spring screw 37.

Also, in some cases, by a flexible member being used as the scooping sheet 36, the waste toner receives a force and cohere by the carrying force and the pressure of the vibration of the spring screw 37, and it has also been found that there is the effect of weakening the toner packing by the elasticity of the flexible member and preventing the cohesion of the toner. However, if the flexible member as the scooping sheet 36 and the spring screw 37 directly contact with each other, the scooping sheet 36 will be overcome and the toner will drip (fall flop) and therefore, it is preferable that as shown in FIG. 1B, a metal plate 39 as an interference preventing member be provided between the scooping sheet 36 and the spring screw 37. In the present embodiment, this metal plate 39 is formed integrally with the mounting metal plate of the scooping sheet 36. Also, the metal plate 39 is provided separately relative to the portion of contact of the scooping sheet 36 with the drum 20, whereby the scooping sheet 36 is prevented from giving an excessively great load to the drum 20.

Now, many electrophotographic copiers and electrophotographic printers up to a low to medium speed of 40 sheets/min. are being used, and being more inexpensive and more compact is desired for these. Therefore, the smaller diameter and lighter weight of the photosensitive drum which is an image bearing member occupying the important portion of the machine are pushed forward, and an OPC photosensitive body comprising an aluminum cylinder having a thin wall of 1 mm or less and a diameter of the order of 30 mm and an organic semiconductor applied thereto has come to be widely used.

However, by the OPC photosensitive body becoming smaller in its wall thickness and diameter, there has conversely occurred the tendency that slight vibration presents itself in images. Thus, the vibration of the OPC photosensitive body itself presents itself as the blur and pitch unevenness by the vibration during the image formation in a laser exposing portion, and by the vibration in a transferring portion, many problematic images are created as shock, blur and transfer deviation.

The OPC photosensitive body made small in its wall thickness and diameter is very sensitive to vibration and depending on the machine, a heavy metal disc such as a flywheel is attached to a driving portion in order to enhance the inertia of the photosensitive drum, thus preventing the occurrence of pitch unevenness and blur.

However, the spring screw 37 is used in the cleaning apparatus 30 according to the present invention and this spring screw 37 is vibrated, whereby there have arisen problems attributable to the irregular rotation/vibration of the spring screw 37 such as unforeseen blur and pitch unevenness of the order of several Hz to several hundreds of Hz which cannot be eliminated even by attaching the flywheel. This is considered to be because the spring screw 37 is disposed near the cleaning blade 34 and therefore a holding-down metal plate for narrowing the operation range of the spring screw 37 so as not to directly contact with the cleaning blade 34 is disposed near the center of the photosensitive drum 20 in the axial direction thereof and the vibration absorbed by the metal plate is transmitted to the whole of the cleaning apparatus 30 to thereby vibrate the photosensitive drum 20.

Therefore, in the present embodiment, the spring screw 37 is disposed near the edge portion of the cleaning blade 34, and the difference between corona charging and the vibration of the photosensitive drum 20 by the charging roller was measured.

An elastic roller having a diameter of 16 mm and asker C hardness of 60° or less for a load of 1 kg was used as the charging roller, and the total pressure was 0 to 3 kg, and the vibration with corona charging was compared and measured.

Thereby, it has been found that the effect of absorbing the vibration by the charging roller appears from 0.5 kg and the vibration can be substantially prevented at 1 kg or greater. Actually in corona charging, the number of rotations of the screw and the double frequency thereof sometimes appeared as the light and shade unevenness of the pitch unevenness of lateral stripes in a uniform halftone image, but it has been confirmed that in a system wherein the charging roller is in close contact with the drum, as in the measurement of vibration, the pitch unevenness considerably decreases at 0.5 kg and the pitch unevenness is eliminated at 1 kg or greater. Accordingly, the total pressure of the charging roller against the drum may preferably be 0.5 kg or greater, and more preferably be 1 kg or greater.

Figure 4:
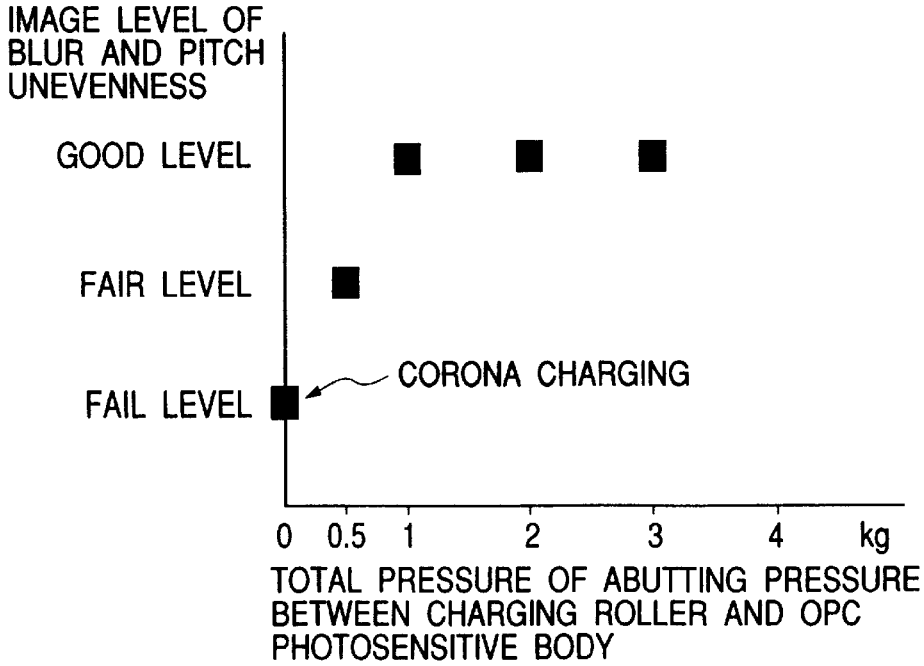
FIG. 4 shows the relation between a charging roller and the image level of blur and pitch unevenness.

FIG. 4 shows the relation between the halftone image level and the close contact pressure between the charging roller and the OPC photosensitive body. As shown in FIG. 4, the maximum value of sound pressure intensity by an acceleration pickup meter and the image level of blur and pitch unevenness are substantially coincident with each other.

When discretely from vibration, the aforementioned fusion was confirmed on an OPC photosensitive body charged by the charging roller and advanced in the number of durable sheets, the number of sheets until fusion occurred was smaller than in the case of a photosensitive body charged by corona charging, and fusion occurred for 2,000 sheets. This seems to be because the charging by the charging roller is not the uniform charging as by corona discharge, but is charging including creeping discharge and therefore disturbs the surface of the photosensitive body. This is remarkable in the case of an organic semiconductor and is also confirmed in SEM which is an electrophotographic microscope. Therefore, it is conceived that the cohering toner on the blade edge portion becomes more liable to adhere to the surface of the drum and fusion occurred early.

As described above, the charging roller is more disadvantageous to fusion than corona discharge, but as in the present embodiment, the spring screw 37 was disposed near the edge portion of the cleaning blade 34 and was vibrated, whereby slight fusion occurred for 10,000 sheets and a result similar to that in the case of corona charging was obtained.

Figure 5:
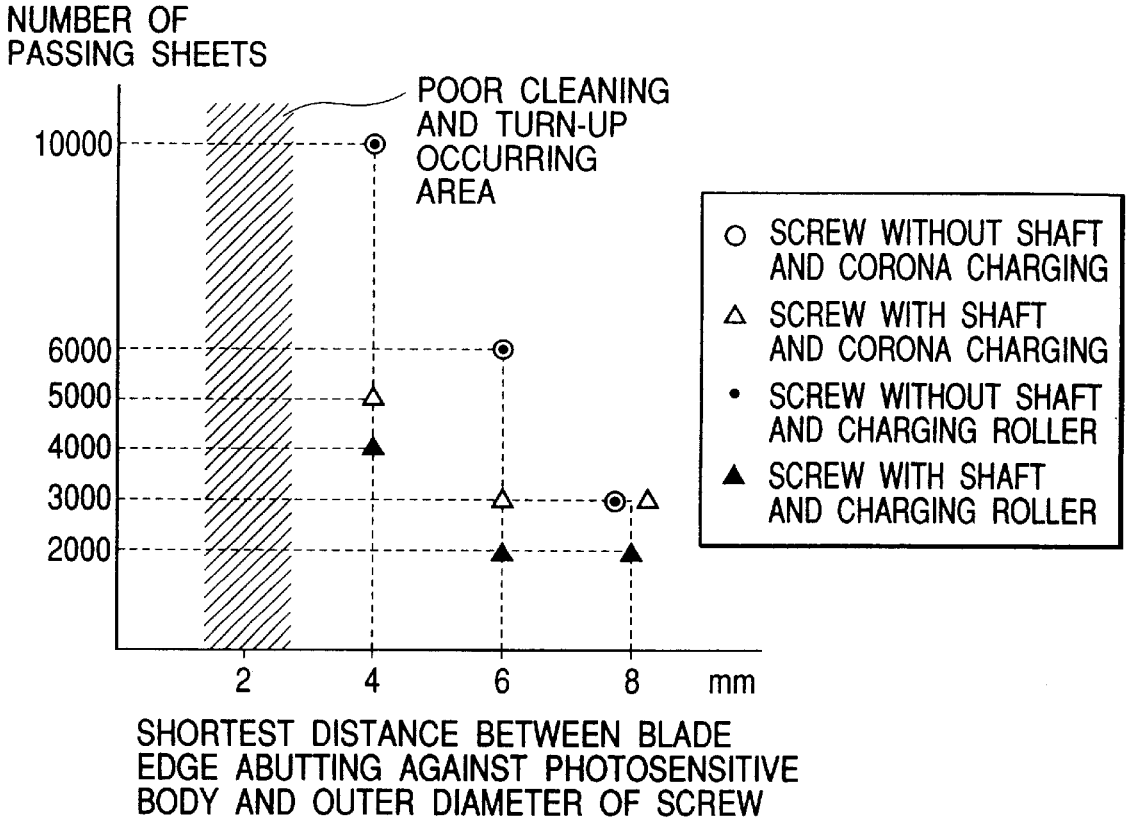
FIG. 5 shows the relation between the shortest distance between the blade edge and the outer diameter of the screw and fusion.

FIG. 5 shows the relation between the number of sheets for which fusion occurred in an experiment carried out under the same measuring condition as the aforedescribed one and the blade edge portion. According to FIG. 5, it is seen that in the case of the screw with a shaft, fusion occurs somewhat earlier for the charging roller than for corona charging, but the difference between the two becomes null by using the screw without a shaft.

The removal of the cohering toner near the blade edge portion is effective against fusion, and can also prevent the vibration of the photosensitive body caused by the charging roller, and by the vibration being absorbed, the deterioration of the quality of image attributable to pitch unevenness, blur, etc. can be restrained and images of high quality can be obtained stably for a long period.

<Embodiment 2>

Embodiment 2 of the present invention will now be described.

Figure 6:
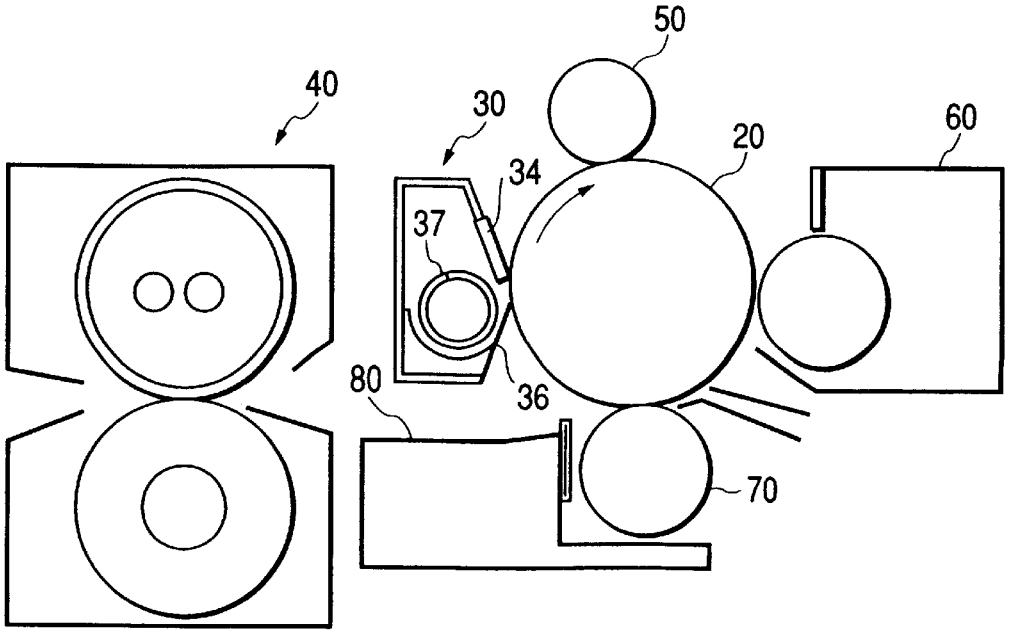
FIG. 6 is a cross-sectional view of the essential portions of an image forming apparatus according to Embodiment 2 of the present invention.

While in Embodiment 1, the spring screw 37 and the charging roller 50 are combined together, whereby images of high quality can be stably obtained with the problems of the two complemented, in the present embodiment, the spring screw 37 and a transferring roller 70 are further combined together as shown in FIG. 6.

A comparison was made between a case where transfer corona charging was used as transferring means and a case where transferring roller charging was used as transferring means. Specifically, the spring screw 37 was disposed near the edge portion of the cleaning blade 34, and the difference between the vibrations of the photosensitive drum 20 by transfer corona charging and transferring roller charging was measured.

As the transferring roller 70, use was made of an elastic roller having a diameter of 18 mm and asker C hardness of 40° or less for a load of 1 kg, and the total pressure was set to 0 to 1 kg, and the vibration with corona charging was compared and measured.

Figure 7:
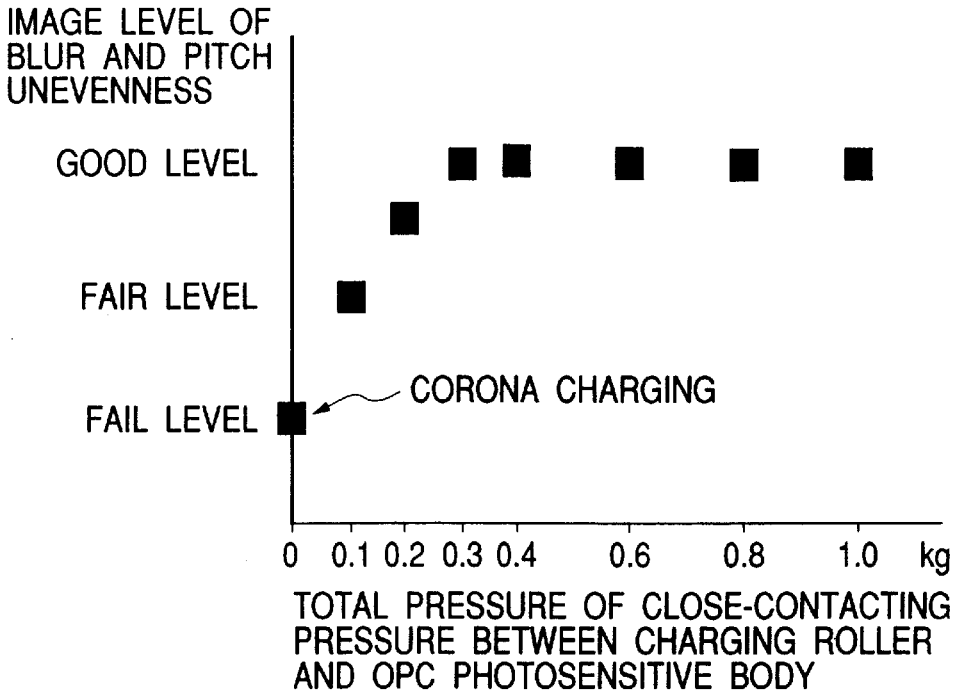
FIG. 7 shows the relation between a transferring roller and the image level of blur and pitch unevenness.

FIG. 7 shows the relation between the halftone image level and the abutting (close contact) pressure between the transferring roller and the OPC photosensitive body. According to FIG. 7, it has been found that from 0.1 kg, the effect of absorbing the vibration by the transferring roller appears, and at 0.3 kg or greater, the vibration can be substantially prevented. Actually in corona charging, the number of rotations of the screw and the double frequency thereof sometimes appeared as the light and shade unevenness of the pitch unevenness of lateral stripes in a uniform halftone image, but it could be confirmed that in a system wherein the transferring roller was in close contact with the drum, as in the measurement of vibration, the pitch unevenness considerably decreased at 0.2 kg, and the pitch unevenness was eliminated at 0.3 kg or greater. It is considered to be because the diameter of the transferring roller is large and the hardness thereof is low, whereby the contact nip becomes wide and can more easily absorb vibration that the effect appears in the prevention of vibration by an amount of pressing smaller than that of the charging roller. Accordingly, the total pressure of the transferring roller against the drum may preferably be 0.1 kg or greater, and more preferably be 0.3 kg or greater.

The transferring roller applies pressure to the OPC photosensitive body particularly during transfer and carries out the transferring step with an electric field and thus, the untransferred toner closely adheres to and coheres on the photosensitive body side and exists thereon, and this closely adhering and cohering untransferred toner becomes more difficult to remove by the cleaning blade than usual.

So, when a fusion experiment similar to that in Embodiment 1 was carried out, fusion likewise occurred for 2,000 sheets on a photosensitive body which had been long used and become liable to cause fusion.

Thus, the pressure contact transferring roller is more disadvantageous to fusion than corona transfer, but when confirmation was done in a system wherein as in the present invention, the spring screw 37 was disposed near the blade edge portion and vibrated, slight fusion occurred for 10,000 sheets and a result similar to that of corona charging was obtained.

The removal of the cohering toner near the blade edge portion is effective against fusion, and can also prevent the vibration of the photosensitive body caused by the transferring roller, and by the vibration being absorbed, the deterioration of the quality of image attributable to pitch unevenness, blur, etc. can be restrained, and images of high quality can be obtained stably for a long period.

Also, if the charging roller and the transferring roller are combined together, the vibration of the photosensitive body can also be prevented, and by the vibration being absorbed, the effect of restraining the deterioration of the quality of image attributable to pitch unevenness, blur, etc. becomes great, and when a fusion confirming experiment was carried out in a system incorporating these two therein, it could be confirmed that in the case of the screw with a shaft, vehement fusion occurred for 2,000 sheets, whereas in the case of the screw without a shaft (spring screw), there was no difference and only slight fusion occurred for 10,000 sheets. This shows that it exhibits a considerable effect for the removal of the cohering toner on the blade edge portion and can prevent the occurrence of fusion to vibrate the screw system without a shaft. That is, by providing the charging roller and the transferring roller for the OPC photosensitive body, the further vibration of the photosensitive body can be prevented, and by the vibration being absorbed, the deterioration of the quality of image attributable to pitch unevenness, blur, etc. can also be restrained, and images of high quality can be obtained stably for a long period.

While the transferring roller has been described above, a similar effect can also be obtained by a transferring belt.

<Embodiment 3>

Embodiment 3 of the present invention will now be described with reference to FIG. 8.

Figure 8:
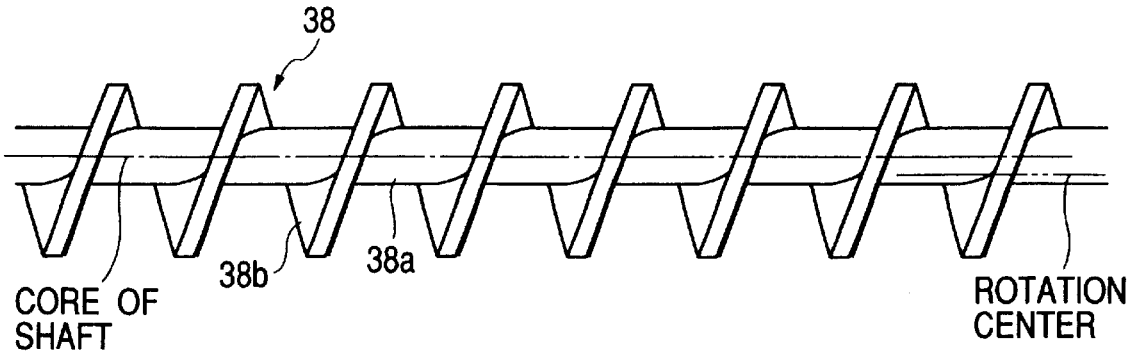
FIG. 8 is a partial side view of the carrying screw of an image forming apparatus according to Embodiment 3 of the present invention.
Figure 9:
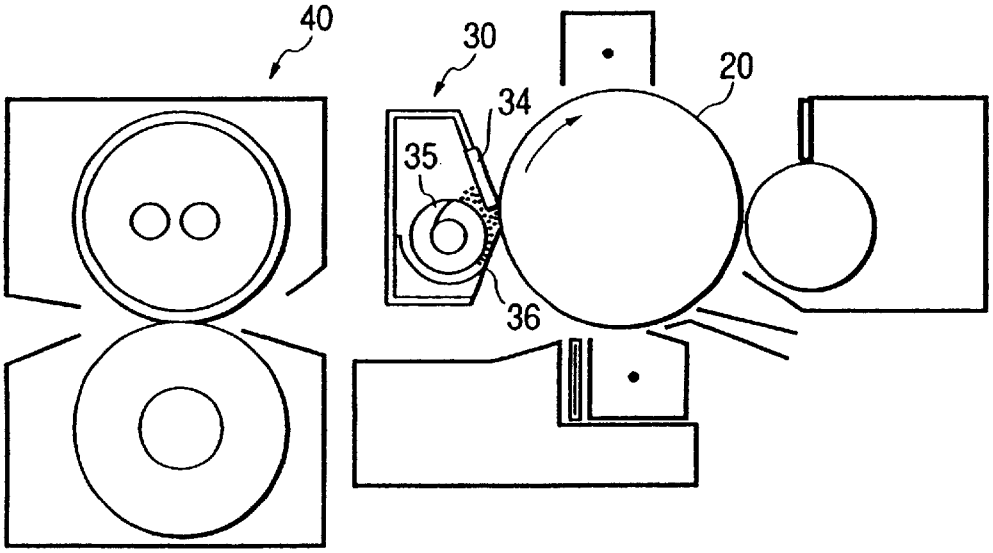
FIG. 9 PRIOR ART
FIG. 9 is a cross-sectional view of the essential portions of an image forming apparatus according to the prior art.

A carrying screw 38 shown in FIG. 8 is formed into a spiral shape having a shaft 38*a*, but the center of rotation of a spiral 38*b* is eccentric from the core of the shaft 38*a*. By this, the carrying screw 38 is vibrated during the rotation thereof. A molded member is used as the material of the carrying screw 38, and the outer diameter and pitch of the spiral 38*b* are set to 15.4 mm and 15 mm, respectively, and the carrying screw 38 is rotatively driven at a number of rotations 4 rps (4 1/s). The distance between the core (the rotation center) of the shaft 38*a* and the center of rotation of the spiral 38*b* is 2 mm. If this distance (amount of offset) is smaller than 1 mm, the vibrating effect is small, and if it is greater than 4 mm, the toner carrying capability is reduced. The shaft 38*a* passes through the interior of the carrying screw 38 and therefore, the cohesion of the toner is somewhat great, by the effect by the eccentric vibration of the carrying screw 38 is great and therefore, a result substantially similar to that of Embodiment 1 could be obtained.

What is claimed is:

1. A cleaning apparatus for cleaning an image bearing member, comprising:

a cleaning member for cleaning a toner from said image bearing member by contacting with said image bearing member; and carrying means for carrying said toner cleaned by said cleaning member, in a direction of a generatrix of said image bearing member, said carrying means being vibrated, a most adjacent distance between said carrying means and a portion of contact of said cleaning member with said image bearing member being smaller than 8 mm.

2. A cleaning apparatus according to claim 1, wherein said carrying means is a screw member having no rotary shaft portion.

3. A cleaning apparatus according to claim 2, wherein said screw member is of a spring shape.

4. A cleaning apparatus according to claim 1, wherein said carrying means is provided with a rotary shaft portion and a spiral portion, and an axis of rotation of said rotary shaft portion and a center of a shape of said spiral portion in a direction perpendicular to said axis differ from each other.

5. A cleaning apparatus according to claim 1, further comprising a sheet member contacting with said image bearing member to prevent the toner from leaking outside of said cleaning apparatus.

6. A cleaning apparatus according to claim 5, further comprising an interference preventing member provided between said sheet member and said carrying means.

7. A cleaning apparatus according to claim 6, wherein said interference preventing member is provided in spaced apart relationship with a portion in which said sheet member contacts with said image bearing member.

8. An image forming apparatus comprising:

an image bearing member;

a cleaning member for cleaning a toner from said image bearing member by contacting with said image bearing member; and carrying means for carrying said toner cleaned by said cleaning member in a direction of a generatrix of said image bearing member, said carrying means being vibrated, a most adjacent distance between said carrying means and a portion of contact of said cleaning member with said image bearing member being smaller than 8 mm.

9. An image forming apparatus according to claim 8, wherein said carrying means is a screw member having no rotary shaft portion.

10. An image forming apparatus according to claim 9, wherein said screw member is of a spring shape.

11. An image forming apparatus according to claim 8, wherein said carrying means is provided with a rotary shaft portion and a spiral portion, and an axis of rotation of said rotary shaft portion and a center of a shape of said spiral portion in a direction perpendicular to said axis differ from each other.

12. An image forming apparatus according to claim 8, further comprising a sheet member contacting with said image bearing member to prevent the toner from leaking.

13. An image forming apparatus according to claim 12, further comprising an interference preventing member provided between said sheet member and said carrying means.

14. An image forming apparatus according to claim 13, wherein said interference preventing member is provided in spaced apart relationship with a portion in which said sheet member contacts with said image bearing member.

15. An image forming apparatus according to claim 8, further comprising a charging member provided in contact with said image bearing member for charging said image bearing member.

16. An image forming apparatus according to claim 15, wherein a total pressure of said charging member against said image bearing member is 0.5 kg or greater.

17. An image forming apparatus according to claim 15, wherein a total pressure of said charging member against said image bearing member is 1 kg or greater.

18. An image forming apparatus according to claim 15, further comprising a transferring member provided in contact with said image bearing member, wherein a toner image is transferred from said image bearing member to a transferring material passing between said image bearing member and said transferring member.

19. An image forming apparatus according to claim 18, wherein a total pressure of said transferring member against said image bearing member is 0.1 kg or greater.

20. An image forming apparatus according to claim 18, wherein a total pressure of said transferring member against said image bearing member is 0.3 kg or greater.

21. An image forming apparatus according to claim 8, further comprising transferring means for transferring a toner image from said image bearing member to a transferring material, and fixing means for fixing said toner image on a transferring material, wherein a distance between a transferring position of said transferring means and a fixing position of said fixing means along a transferring material conveying path is 147 mm or less.

22. A cleaning apparatus according to claim 1, further comprising an interference preventing member for regulating a movement of said carrying means directing toner to said cleaning member.

23. An image forming apparatus according to claim 8, further comprising an interference preventing member for regulating a movement of said carrying means directing toner to said cleaning member.

24. A cleaning apparatus for cleaning an image bearing member, comprising:

a cleaning member for cleaning a toner from said image bearing member by contacting with said image bearing member; and carrying means for carrying said toner cleaned by said cleaning member by being rotated, in a direction of a generatrix of said image bearing member, said carrying means being vibrated, a most adjacent distance between an outside diameter of said carrying means being rotated and a portion of contact of said cleaning member with said image bearing member being smaller than 8 mm.

* * * * *